US007065318B2

(12) United States Patent
Miki

(10) Patent No.: US 7,065,318 B2
(45) Date of Patent: Jun. 20, 2006

(54) PAPER FEEDER AND IMAGE FORMING APPARATUS

(75) Inventor: Katsuhiko Miki, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 13 days.

(21) Appl. No.: 10/912,058

(22) Filed: Aug. 6, 2004

(65) Prior Publication Data

US 2005/0069360 A1 Mar. 31, 2005

(30) Foreign Application Priority Data

Aug. 7, 2003 (JP) ..... 2003-288868

(51) Int. Cl.
*G03G 15/00* (2006.01)

(52) U.S. Cl. ..... 399/391; 399/388

(58) Field of Classification Search ..... 399/391, 399/388, 393; 271/121–127
See application file for complete search history.

(56) References Cited

U.S. PATENT DOCUMENTS

| | | | | |
|---|---|---|---|---|
| 4,228,992 | A | 10/1980 | Ashburner | 270/59 |
| 5,758,250 | A | 5/1998 | Miki | 399/393 |
| 5,823,525 | A | 10/1998 | Miki | 271/127 |
| 5,848,787 | A | 12/1998 | Miki | 271/127 |
| 5,934,667 | A | 8/1999 | Miki | 271/152 |
| 6,585,253 | B1 | 7/2003 | Miki | 271/125 |
| 6,601,843 | B1 | 8/2003 | Miki | 271/10.13 |
| 6,631,899 | B1 | 10/2003 | Miki | 271/115 |
| 6,819,897 | B1 | 11/2004 | Kita | 399/223 |
| 2002/0020959 | A1 | 2/2002 | Matsuda et al. | 271/122 |
| 2003/0185585 | A1 | 10/2003 | Kimura et al. | 399/94 |
| 2003/0215267 | A1 | 11/2003 | Kita | 399/258 |
| 2003/0219279 | A1 | 11/2003 | Nohsho et al. | 399/159 |
| 2004/0046310 | A1 | 3/2004 | Miki | 271/121 |
| 2004/0131390 | A1 | 7/2004 | Kita | 399/258 |
| 2004/0136760 | A1 | 7/2004 | Yoshida et al. | 399/302 |

FOREIGN PATENT DOCUMENTS

| | | |
|---|---|---|
| JP | 61-33437 | 2/1986 |
| JP | 2-231324 | 9/1990 |
| JP | 4-39238 | 2/1992 |
| JP | 4-361931 | 12/1992 |
| JP | 2001-206592 | 7/2001 |

*Primary Examiner*—Anthony H. Nguyen
(74) *Attorney, Agent, or Firm*—Oblon, Spivak, McClelland, Maier & Neustadt, P.C.

(57) ABSTRACT

A paper feeder includes a plurality of paper feeding units that feeds a recording medium from a paper feeding tray, has a first guiding surface towards a paper transporting path that guides the recording medium, and is arranged along a direction of transporting the recording medium, and a transporting guide that has a second guiding surface towards the paper transporting path between the paper feeding units. The transporting guide is arranged in such a manner that the second guiding surface is overlapped with the first guiding surface of at least one of the paper feeding units adjacent to the transporting guide on either of an upstream side and a downstream side in the direction of transporting the recording medium.

6 Claims, 5 Drawing Sheets

PAPER FEEDER AND IMAGE FORMING APPARATUS

CROSS-REFERENCE TO RELATED APPLICATIONS

The present document incorporates by reference the entire contents of Japanese priority document, 2003-288868 filed in Japan on Aug. 7, 2003.

BACKGROUND OF THE INVENTION

1) Field of the Invention

The present invention relates to a technology for feeding a recording medium in an image forming apparatus.

2) Description of the Related Art

A conventional paper feeder picks up a sheet of paper from a pile of paper stacked in a paper feeding tray with a pick-up roller, transfers the paper between a feed roller and a sheet separator to separate the paper, and then carries the paper with a pair of transporting rollers that is disposed in a downstream side. The paper feeder is formed as a separate paper feeding unit that includes the feed roller and the transporting roller from the paper feeding tray.

FIG. 5 is a cross-sectional view of a relevant part of the conventional paper feeder. The paper feeder, in this example, includes four paper trays 101 stacked in a vertical direction. Each of the paper trays contains a paper of a different size. Each of the paper trays 101 includes a paper feeding unit 103. The paper feeding unit 103 includes a pick-up roller 105 that is in contact with the top of the pile of the paper contained in a corresponding paper tray 101, a feed roller 107 that is disposed on a downstream side of the pick-up roller 105 in a paper transporting path 109, and a pair of transporting rollers 111 that carry the paper along the paper transporting path 109.

With this mechanism, if an interval between the paper feeding units 103 varies depending on models of the image forming apparatuses, the paper feeding unit should be manufactured for each model. As a result, single type of the paper feeding unit cannot be commonly used for various models of the image forming apparatus.

SUMMARY OF THE INVENTION

It is an object of the present invention to solve at least the above problems in the conventional technology.

A paper feeder according to one aspect of the present invention includes a plurality of paper feeding units that feeds a recording medium from a paper feeding tray, the paper feeding units having a first guiding surface towards a paper transporting path, the first guiding surface being arranged along a direction of transporting the recording medium; and a transporting guide that has a second guiding surface towards the paper transporting path between the paper feeding units. The transporting guide is arranged in such a manner that a part of the second guiding surface is overlapped with a part of the first guiding surface of at least one of the paper feeding units adjacent to the transporting guide on either of an upstream side and a downstream side in the direction of transporting the recording medium.

An image forming apparatus according to another aspect of the present invention includes a paper feeder that includes a plurality of paper feeding units that feeds a recording medium from a paper feeding tray, the paper feeding units having a first guiding surface towards a paper transporting path, the first guiding surface being arranged along a direction of transporting the recording medium; and a transporting guide that has a second guiding surface towards the paper transporting path between the paper feeding units. The transporting guide is arranged in such a manner that a part of the second guiding surface is overlapped with a part of the first guiding surface of at least one of the paper feeding units adjacent to the transporting guide on either of an upstream side and a downstream side in the direction of transporting the recording medium.

The other objects, features, and advantages of the present invention are specifically set forth in or will become apparent from the following detailed description of the invention when read in conjunction with the accompanying drawings.

DETAILED DESCRIPTION

Exemplary embodiments of a paper feeder and an image forming apparatus according to the present invention are described in detail below with reference to accompanying drawings.

Figure 1:
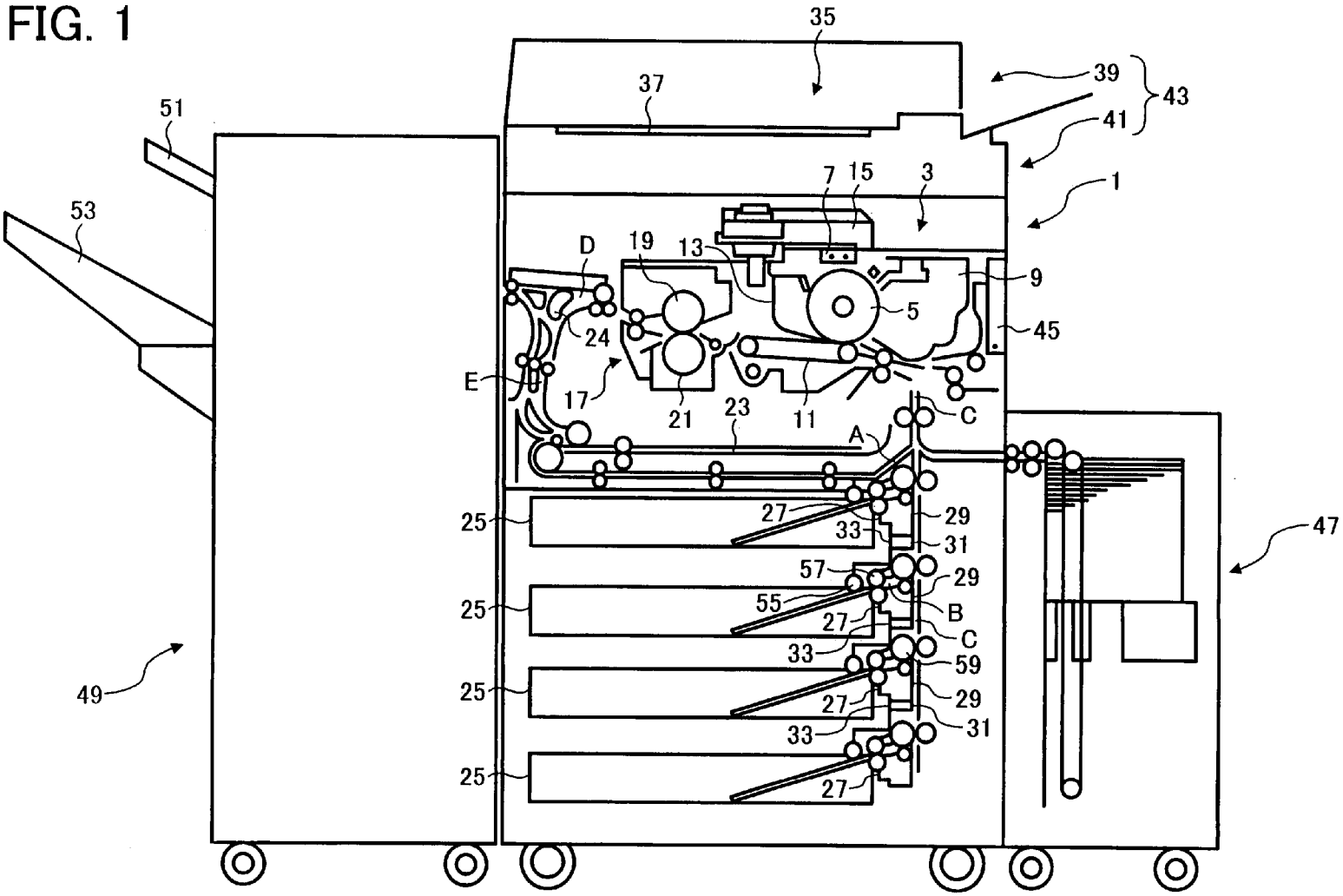
FIG. 1 is a side view of an image forming apparatus to which a paper feeder according to a first embodiment of the present invention is applied.

FIG. 1 is a side view of an image forming apparatus to which a paper feeder according to a first embodiment of the present invention is applied. The image forming apparatus shown in FIG. 1 is a copier. However, the present invention is not restricted to the copier only, and is also applicable to a printer, a facsimile, and a printing machine.

A main body 1 of the image forming apparatus includes an image forming section 3 that includes an image carrier (photosensitive drum) 5 in the form of a drum, a charging unit 7, a developing unit 9, a transferring-transporting unit 11, and a cleaning unit 13 that are disposed around the image carrier 5.

A laser writing unit 15 is provided above the image forming section 3. The laser writing unit 15 includes a light source such as a laser diode, a rotating polygon mirror for scanning, a polygon motor, and a scanning optical system like an fθ lens or a mirror (not shown).

The image forming section 3 further includes a fixing unit 17 that is disposed on a left side of the cleaning unit 13 as shown in FIG. 1. The fixing unit 17 includes a fixing roller 19 and a pressure roller 21. The fixing roller 19 has a built in heater. The pressure roller 21 presses against the fixing roller 19 from a direction below the fixing roller 19.

A double-sided unit 23 and paper feeding trays 25 are disposed on a bottom side in the main body 1 of the image forming apparatus. The paper feeding trays 25 are arranged in layers. The paper feeding trays 25 include sheet materials such as paper sheets and overhead projector (OHP) transparencies. Each of the paper feeding trays 25 includes a paper feeding unit 27 that carries the sheet material to a paper transporting path C. The paper feeding units 27 are disposed along the paper transporting path C. The details are described in the later part. The paper feeding unit 27 includes a guiding surface 29 towards the paper transporting path C, forming one side of the paper transporting path C. A transporting guide 33 is disposed between the paper feeding units 27. The transporting guide 33 includes a guiding surface 31 towards the paper transporting path C also forming the one side of the paper transporting path C.

An arrangement is made such that the sheet material from the double-sided unit 23 and from the paper feeding tray 25 is carried via a paper re-feeding path A and a common path B respectively, to the paper transporting path C, which is a common path, and that extends up to a part below the image carrier 5. The double-sided unit 23 includes a guiding claw 24 in the middle portion of a paper discharging path D that is connected to an outlet of the fixing unit 17. The guiding claw 24 makes the sheet material diverge out from the middle portion of the paper discharging path D and to be transported to an inverting path E.

The main body 1 includes an image reader 35 to read an image from a document in its upper part as shown in FIG. 1. An exposure glass 37 is disposed on a top side of the image reader 35. The main body 1 includes an automatic document feeder 39 that is openable. The image reader 43 includes the automatic document feeder 39 and an optical reader 41.

The main body 1 includes an openable bypass tray 45 that guides a sheet that is fed manually to the paper transporting path C on a right side in FIG. 1. A bulk paper feeder 47 that is provided as a separate unit is arranged on a right side of the main body 1 as shown in FIG. 1. The bulk paper feeder 47 stores sheets that are to be used for continuously copying in large quantity. A large number of sheets are stored in the bulk paper feeder 47.

A sheet post-processing unit 49 that is provided as a separate unit is arranged on an opposite side of the main body 1 from the side in which the bulk paper feeder 47 is arranged. The sheet post-processing unit 49 receives sheets discharged from the paper discharging path D. A post processing such as stapling and punching holes is performed in the sheet post-processing unit 49 as required, and then, the sheets are discharged in either an upper or a lower paper discharging trays 51 and 53.

Figure 2:
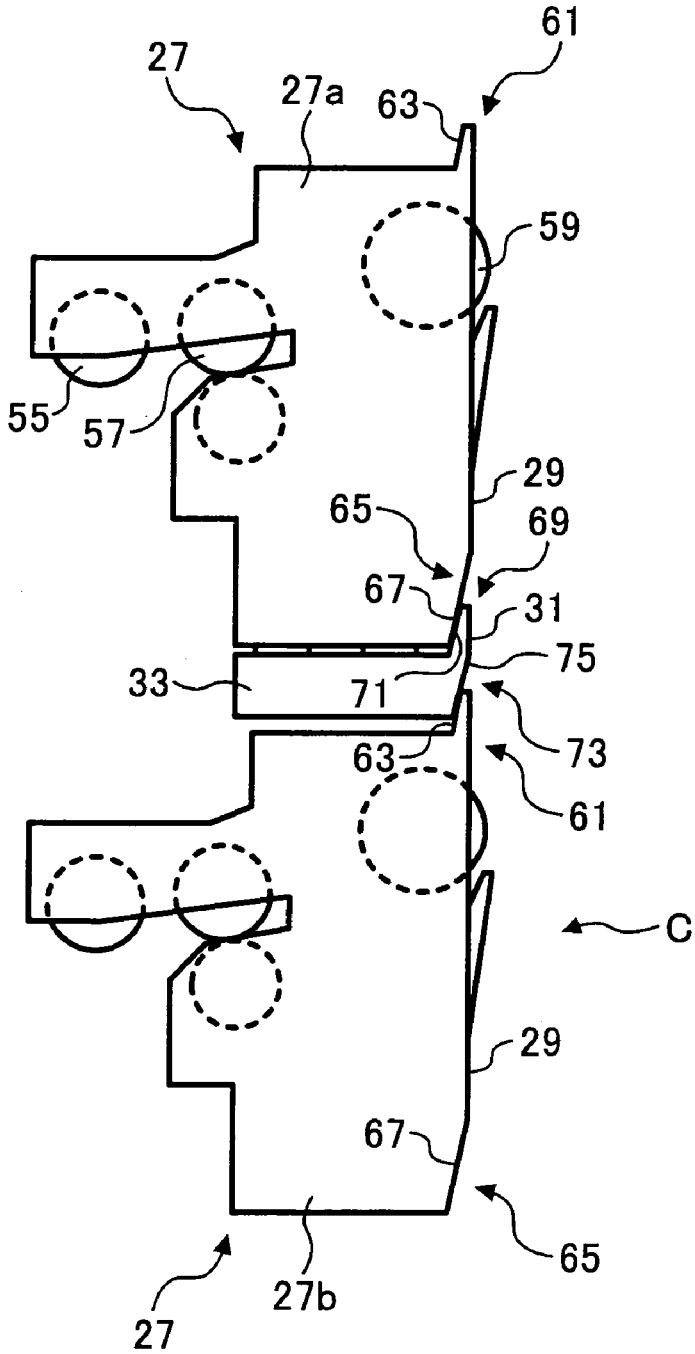
FIG. 2 is a side view of a structure around a paper feeding unit and a transporting guide shown in FIG. 1.
Figure 3:
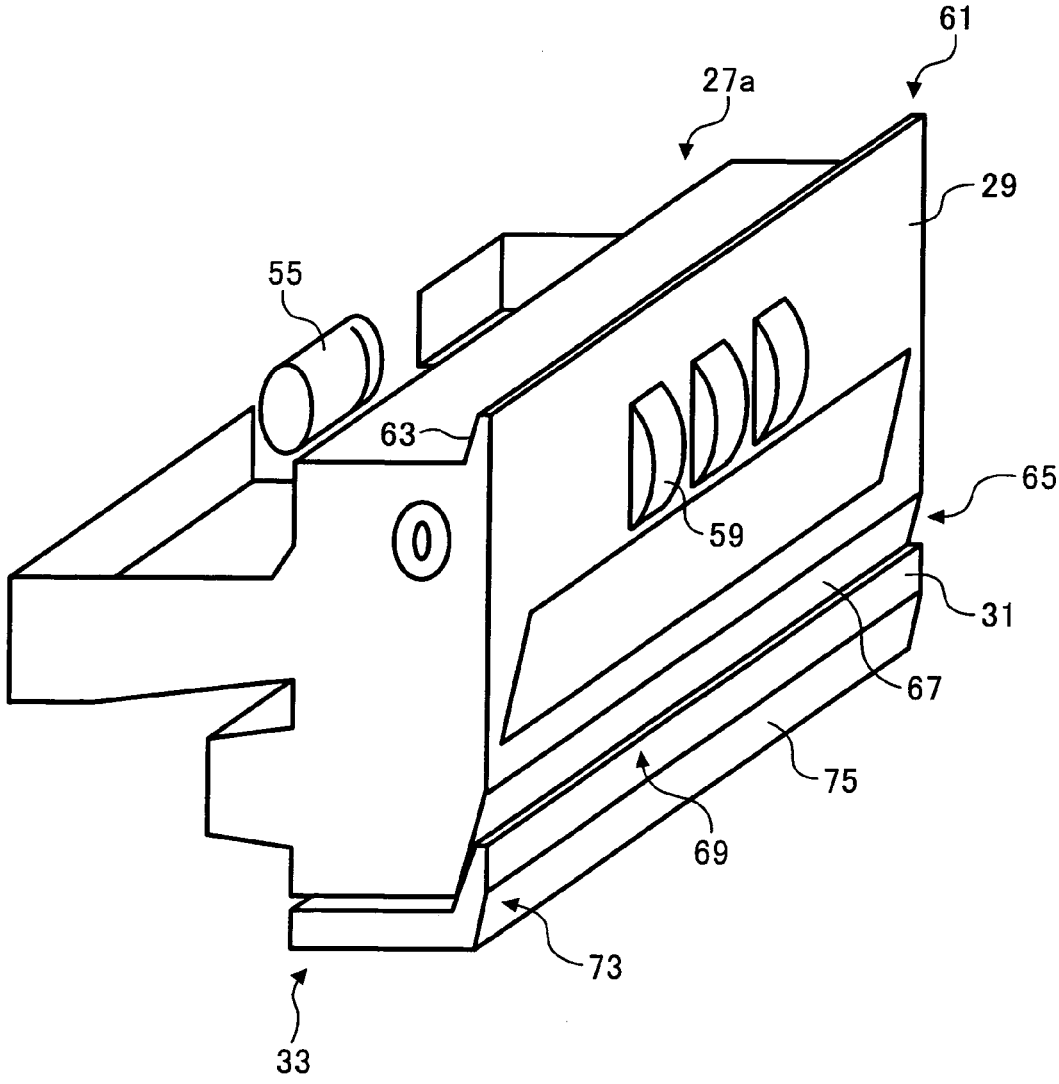
FIG. 3 is a perspective view of the structure shown in FIG. 2.

FIG. 2 is a side view of a structure around the paper feeding units 27 and the transporting guide 33. FIG. 3 is a perspective view of the structure around the paper feeding units 27 and the transporting guide 33.

As shown in FIGS. 2 and 3, the transporting guide 33 is disposed between paper feeding units 27*a* and 27*b* from among the paper feeding units 27, which are disposed along the paper transporting path C. The transporting guide 33 is fixed, by a screw or by a snap fit, to an edge surface that is on an upstream side in a direction of transporting paper in the paper feeding unit 27*a*. The paper feeding unit 27*a* is arranged in a position that is downstream to the paper feeding unit 27*b* in the direction of transporting paper.

Each of the paper feeding units 27*a* and 27*b* includes a pick-up roller 55, a feed roller 57, and a transporting roller 59. The pick-up roller 55 is in contact with a sheet that is situated at the top of the sheets stored in the paper feeding tray 25. The feed roller 57 is disposed in a position that is downstream to the pick-up roller 55 in the direction of transporting paper. The transporting roller 59 carries the sheets along the paper transporting path C. On a surface of the paper feeding unit 27 that is on an opposite side to a side on which the pick rollers 55 is disposed, the guiding surface 29 is arranged. A protruding portion 61 is formed on the guiding surface 29 on an edge that is on the downstream side in the direction of transporting paper. The protruding portion 61 protrudes along the direction of transporting. A surface of the protruding portion 61 that faces the paper transporting path C is in the same plane as the surface of the guiding surface 29. A surface of the protruding portion 61 on the opposite side of the paper transporting path C is formed as a tapered surface 63 that gradually becomes narrow towards the direction of transporting paper. On a side of the paper feeding units 27*a* and 27*b* on which the guiding surface 29 is arranged, a notch 65 is arranged at an edge that is on the upstream side in the direction of transporting paper. The notch 65 is formed as a notch that is cut in a slanting direction. An inclined surface 67 is formed on the notch 65. The inclined surface 67 is formed such that a surface of the notch 65 gradually becomes closer to the guiding surface 29 as it extends from the edge. An edge of the inclined surface 67 is connected to the guiding surface 29 at a side that is downstream in the direction of transporting paper.

The transporting guide 33, which is disposed between the paper feeding units 27*a* and 27*b*, has an edge surface with a shape substantially similar to the edge surface of the paper feeding units 27*a* and 27*b* that is at the upstream and the downstream side in the direction of transporting paper. The height of the transporting guide 33 is slightly less than an interval between the paper feeding units 27*a* and 27*b*. The transporting guide 33 has a guiding surface 31 that faces the paper transporting path C. A protruding portion 69 that protrudes along the direction of transporting paper is formed on an edge of the guiding surface 31 that is on the downstream side in the direction of transporting paper. A surface of the protruding portion 69 on the opposite side of the paper transporting path C is formed as a tapered surface 71 that gradually becomes narrow towards the direction of transporting paper. On a side of the guiding surface 31 of the transporting guide 33, a notch 73 that is cut in a slanting direction is formed on an edge that is on the upstream side in the direction of transporting paper. An inclined surface 75 is formed on the notch 73. The inclined surface 75 is formed such that a surface of the notch 73 becomes closer to the guiding surface 31 as it extends from the edge. An edge of the inclined surface 75 is connected to the guiding surface 31 at the downstream side in the direction of transporting paper.

The guiding surface 31 of the transporting guide 33 and the guiding surface 29 of the paper feeding units 27*a* and 27*b* are in the same plane and form a surface on one side of the paper transporting path C. Moreover, the guiding surface 31 overlaps the guiding surface 29 of the adjacent paper feeding units 27*a* and 27*b* on the upstream and the downstream side of the direction of transporting paper. In other words, the protruding portion 69 of the transporting guide 33 fits the notch 65 of the paper feeding unit 27 adjacent on the downstream side in the direction of transporting paper. The protruding portion 69 and the notch 65 are formed in such a manner that the tapered surface 71 of the protruding portion 69 and the tapered surface 67 of the notch 65 have substantially similar inclinations. Therefore, the protruding portion 69 can overlap the paper feeding unit 27*a* at the notch 65 such that the protruding portion 69 fits in a part of the inclined surface 67 of the notch 65. Similarly, the protruding portion 61 of the paper feeding unit 27*b* that is adjacent and that is on the upstream side to the transporting guide 33 in the direction of transporting paper fits the notch 75 of the transporting guide 33. The protruding portion 61 of the paper feeding unit 27*b* and the notch 73 of the transporting guide 33 are formed in such a manner that the tapered surface 63 of the protruding portion 61 and the tapered surface 75 of the notch 73 have substantially similar inclinations. Therefore, the protruding portion 61 can overlap the transporting guide 33 at the notch 73 such that the protruding portion 61 fits in a part of the inclined surface 75 of the notch 73.

A length of the protruding portion 69 is not limited to a specific value provided that the protruding portion 69 fits into the notch 65 of the paper feeding unit 27*a* adjacent on the downstream side of the direction of transporting paper. Similarly, a length of the protruding portion 61 is not restricted provided that the protruding portion fits in the notch 73. The height of the transporting guide 33 is not restricted provided that the transporting guide can be accommodated between the paper feeding units 27*a* and 27*b*.

An operation of the paper feeding unit will be explained. A sheet that is fed from the paper feeding tray 25 by the pick-up roller 55 and the feed roller 57 is carried to the paper transporting path C by the transporting roller 59. The sheet is then carried through the paper transporting path C towards the image carrier 5 along the direction of transporting paper. The protruding portion 61 of the paper feeding unit 27*b* overlaps the transporting guide 33 such that the protruding portion 61 fits in the notch 73 of the transporting guide 33, and thus, a step is formed in a descending form towards the direction of transporting paper. The protruding portion 69 of the transporting guide 33 overlaps the paper feeding unit 27*a* such that the protruding portion 69 fits in the notch 65 of the paper feeding unit 27*a*, and thus, a step is formed in a descending form towards the direction of transporting paper. The steps formed enable smooth transportation of the sheet to the paper transporting path C without getting snagged at overlapping portions (the protruding portion 61 fitting in the notch 73 and the protruding portion 69 fitting in the notch 65) between the paper feeding units 27*a* and 27*b*.

Thus, in the paper feeding unit according to the present invention, the transporting guide 33 is provided separately from the paper feeding units 27*a* and 27*b*, and is arranged between the paper feeding units 27*a* and 27*b*. Therefore, even if the interval between the paper feeding units 27*a* and 27*b* varies depending on a model of the image forming apparatus, the difference in the interval can be compensated easily by changing only the transporting guide 33. The paper feeding units 27 can be commonly used for different models of image forming apparatuses. Moreover, there is no need to change the design of the paper feeding units 27 for each of the models. This enables sharing of a single type of the paper feeding unit between different models of the image forming apparatuses at low cost.

The transporting guide 33 overlaps the adjacent paper feeding units 27*a* and 27*b* such that the transporting guide 33 forms steps in a descending form towards the direction of transporting paper. Therefore, when the sheet is being carried, it does not get snagged at the overlapping portions, thereby allowing the sheet to be carried smoothly through the paper transporting path C without causing a defect such as tip bending.

Figure 4:
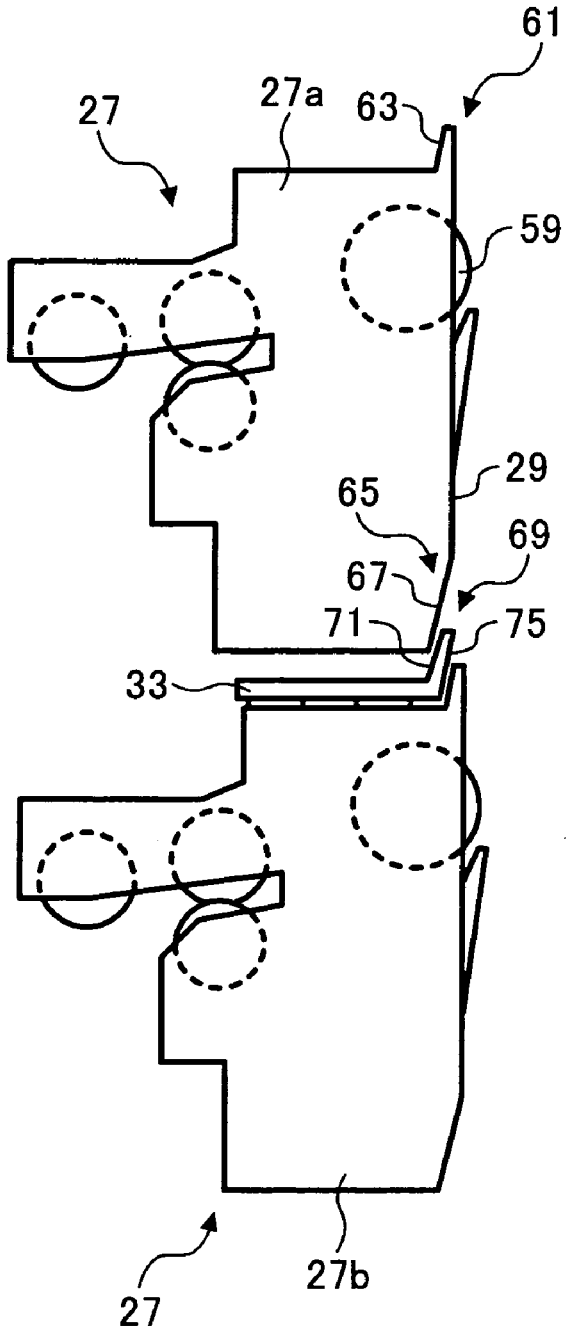
FIG. 4 is an enlarged side view of a structure around a paper feeding unit and a transporting guide in a paper feeder according to a second embodiment of the present invention.
Figure 5:
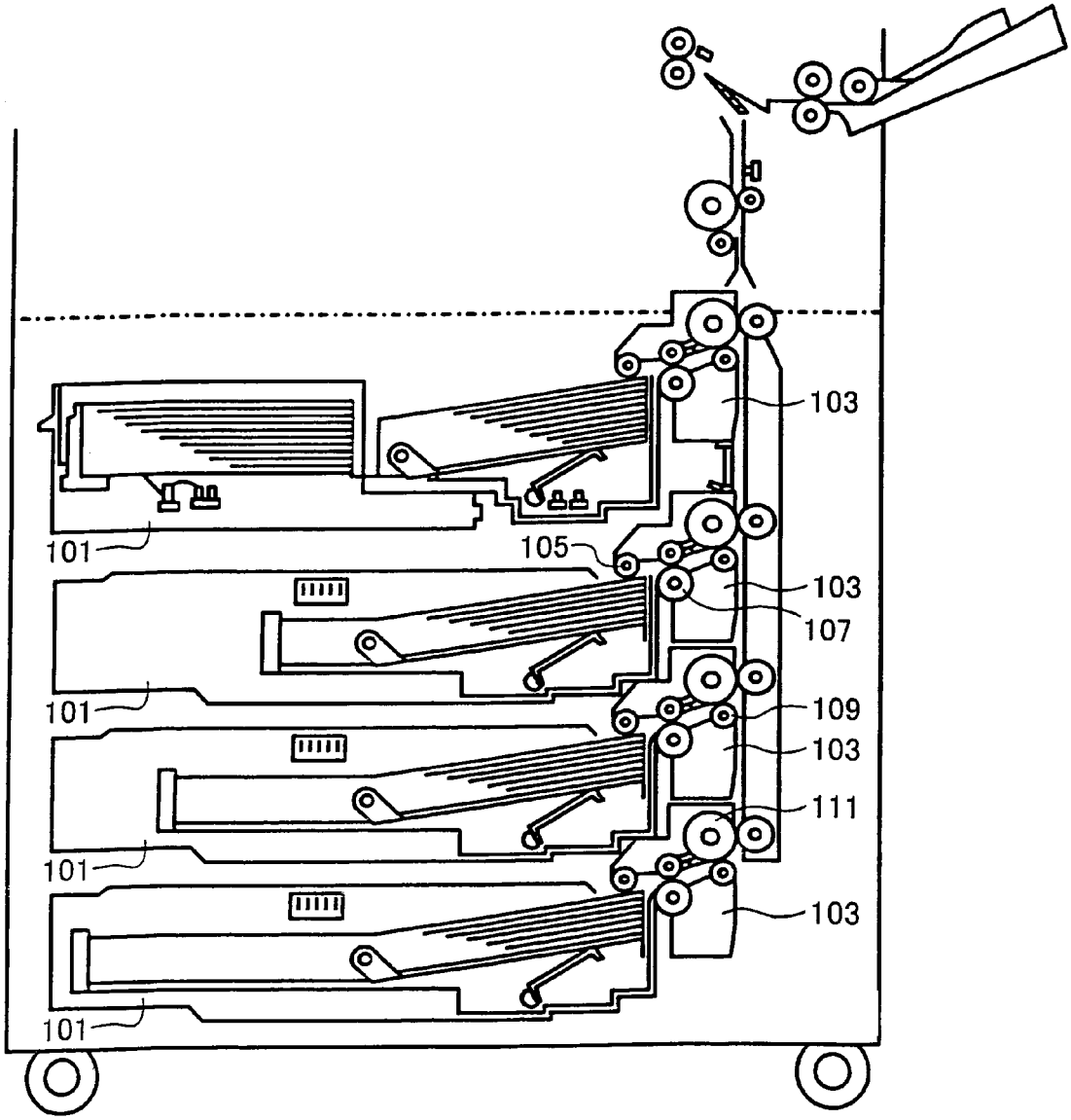
FIG. 5 RELATED ART
FIG. 5 is a side view of a conventional image forming apparatus.

FIG. 4 is an enlarged side view of a structure around the paper feeding units 27 and the transporting guide 33 according to a second embodiment of the present invention.

The second embodiment differs from the first embodiment in fixing the transporting guide 33 to the paper feeding unit 27. Unlike the first embodiment, the transporting guide 33 is fixed, by a screw or by a snap fit, to the paper feeding unit 27*b*, which is adjacent to the transporting guide 33 on the upstream side in the direction of transporting paper, at an edge surface that is on the downstream side in the direction of transporting of paper. Moreover, the interval between the paper feeding units 27*a* and 27*b* according to the second embodiment is shorter compared to the paper feeding units 27*a* and 27*b* according to the first embodiment. Thus, the transporting guide 33 that has a shorter height than the transporting guide 33 in the first embodiment is disposed between the paper feeding units 27*a* and 27*b*.

Therefore, the transporting guide 33 can be disposed on either of the edge surfaces of the paper feeding unit 27, which are the edge surface on the upstream side (the first embodiment) and the edge surface on the downstream side (the second embodiment) in the direction of transporting paper. As a result, the flexibility in design of the paper feeder and the image forming apparatus is enhanced. Furthermore, a single type of the paper feeder can be commonly used for different models of the image forming apparatuses with ease.

The exemplary embodiments of the paper feeder and the image forming apparatus according to the first and the second embodiments have been described. However, the present invention is not limited to these embodiments, and other type of embodiments within the scope of claims can be executed.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A paper feeder comprising:

a plurality of paper feeding units that feeds a recording medium from a paper feeding tray, the paper feeding units having a first guiding surface towards a paper transporting path, the first guiding surface being arranged along a direction of transporting the recording medium; and a transporting guide that has a second guiding surface towards the paper transporting path between the paper feeding units, wherein the transporting guide is arranged in such a manner that a part of the second guiding surface is overlapped with a part of the first guiding surface of at least one of the paper feeding units adjacent to the transporting guide on either of an upstream side in the direction of transporting the recording medium and a downstream side opposite the direction of transporting the recording medium.

2. The paper feeder according to claim 1, wherein the transporting guide includes a first protruding portion that protrudes along the direction of transporting the recording medium on the second guiding surface on the downstream side and a first notch that is formed on the second guiding surface on the upstream side, the paper feeding unit includes a second protruding portion that protrudes along the direction of transporting the recording medium on the first guiding surface on the downstream side and a second notch that is formed on the first guiding surface on the upstream side, and the part of the paper feeding unit is overlapped with the part of the transporting guide in such a manner that the first protruding portion fits in the second notch, and the second protruding portion fits in the first notch.

3. The paper feeder according to claim 1, wherein the transporting guide is fixed to the paper feeding unit on at least one of the upstream side and the downstream side.

4. An image forming apparatus comprising a paper feeder that includes a plurality of paper feeding units that feeds a recording medium from a paper feeding tray, the paper feeding units having a first guiding surface towards a paper transporting path, the first guiding surface being arranged along a direction of transporting the recording medium; and a transporting guide that has a second guiding surface towards the paper transporting path between the paper feeding units, wherein the transporting guide is arranged in such a manner that a part of the second guiding surface is overlapped with a part of the first guiding surface of at least one of the paper feeding units adjacent to the transporting guide on either of an upstream side in the direction of transporting the recording medium and a downstream side opposite the direction of transporting the recording medium.

5. The image forming apparatus according to claim 4, wherein the transporting guide includes a first protruding portion that protrudes along the direction of transporting the recording medium on the second guiding surface on the downstream side and a first notch that is formed on the second guiding surface on the upstream side, the paper feeding unit includes a second protruding portion that protrudes along the direction of transporting the recording medium on the first guiding surface on the downstream side and a second notch that is formed on the first guiding surface on the upstream side, and the part of the paper feeding unit is overlapped with the part of the transporting guide in such a manner that the first protruding portion fits in the second notch, and the second protruding portion fits in the first notch.

6. The image forming apparatus according to claim 4, wherein the transporting guide is fixed to the paper feeding unit on at least one of the upstream side and the downstream side.

* * * * *